US005787335A

United States Patent [19]

Novak

[11] Patent Number: 5,787,335

[45] Date of Patent: Jul. 28, 1998

[54] DIRECT BROADCAST SATELLITE SYSTEM FOR MULTIPLE DWELLING UNITS

[75] Inventor: Abram Novak, Brooklyn, N.Y.

[73] Assignee: Ethnic-American Broadcasting Co, LP, Fort Lee, N.J.

[21] Appl. No.: 751,320

[22] Filed: Nov. 18, 1996

[51] Int. Cl.[6] ..... H04N 7/16

[52] U.S. Cl. ..... 455/3.2; 455/6.2; 348/10; 348/8

[58] Field of Search ..... 455/3.1, 3.2, 4.2, 455/4.1, 5.1, 6.1, 6.2, 6.3, 101, 103, 137, 139, 427, 12.1; 348/6, 7, 8, 9, 10, 11, 12, 13, 14, 15, 16, 17, 18; 342/361, 362, 363, 364, 365, 366; H04N 7/16, 7/173, 7/20

[56] References Cited

U.S. PATENT DOCUMENTS 4,520,508 5/1985 Reichert, Jr. ..... 348/11
4,802,239 1/1989 Ooto ..... 455/277
5,276,904 1/1994 Mutzig et al. ..... 455/6.2
5,485,196 1/1996 Nathan et al. ..... 455/6.2
5,565,805 10/1996 Nakagawa et al. ..... 455/3.2
5,568,158 10/1996 Gould ..... 343/756
5,574,964 11/1996 Hamlin ..... 455/3.1
5,574,965 11/1996 Welmer ..... 455/3.2

*Primary Examiner*—Chris Grant
*Attorney, Agent, or Firm*—Baker & Botts, LLP

[57] ABSTRACT

A system is provided for distribution of broadcast and direct satellite television signals to multiple users, for example, within a multiple dwelling building. In one embodiment broadcast signals are combined with right and left-hand satellite signals and provided by a dual transmission line distribution system to user locations. In an alternate embodiment, satellite signals corresponding to one polarization are converted to a separate frequency band to provide a combined signal incorporating left and right- hand corresponding satellite signals and broadcast signals for distribution.

8 Claims, 5 Drawing Sheets

DIRECT BROADCAST SATELLITE SYSTEM FOR MULTIPLE DWELLING UNITS

BACKGROUND OF THE INVENTION

This invention relates to systems for receiving direct satellite signals for television, and particularly to arrangements for receiving such signals in a multiple-dwelling environment.

Direct satellite television systems for use in private homes have recently become popular as a replacement for cable television service. A typical single family home installation for such systems is shown in block diagram in FIG. 1. The system includes a parabolic satellite receiving antenna 12, which provides separate signal outputs corresponding to satellite transmission signals which are left-hand and right-hand circularly polarized. A switch 14 is provided in the vicinity of receiving antenna 12 to select one of the antenna output signals, according to the desired viewing channel. Within the home there is provided a satellite receiver 16 which has separate RF cable inputs for receiving signals from satellite antenna 12 over cable 20 and signals from off-air receiving antenna 18 over cable 22.

When receiver 16 is tuned to receive off-air television broadcast signals, an internal RF switch connects antenna cable 22 to output cable 23 and a television set 24.

When receiver 16 is tuned for satellite reception, the satellite signal on cable 20 is down converted by receiver 16 to a selected television channel, and the signal as converted, is provided to television set 24 on cable 23. A control signal for the operation of switch 14 is provide by receiver 16 on RF cable 20, according to the selected satellite channel.

While the configuration of FIG. 1 is effective in a single-family home environment, it cannot effectively be used in a multi-family dwelling unit, because of the need to switch antenna polarization according to the satellite viewing channel selected by the receiver.

It is an object of the present invention to provide a direct-satellite television receiving configuration suitable for use in a multiple-dwelling environment, wherein a common satellite antenna and a common off-air broadcast receiving antenna are used to provide signals to multiple apartment units in a multiple-dwelling environment in an arrangement wherein the occupants of each dwelling unit have an option of whether to receive satellite broadcasts by subscription, and have the capability to select either a broadcast channel or a satellite viewing channel independently of channel selections by other subscribers within the multiple-dwelling environment.

It is a further object of the invention to provide such a system which uses commercially available components or components having only minor modifications.

SUMMARY OF THE INVENTION

In accordance with one aspect of the invention there is provided a system for distributing satellite television signals to multiple users. The system includes a satellite antenna system for receiving satellite signals with first and second polarization and for providing such signals on output first and second transmission lines. The system includes a dual transmission line distribution system for providing signals corresponding to both polarizations to a plurality of user locations, and a switch at each selected user location for selectively connecting either the first or second signal to a satellite receiver.

In a preferred embodiment the system further includes a broadcast signal antenna system for receiving broadcast signals and combining them with at least one of the satellite signals for distribution in the dual transmission-line distribution system. At each user location there may be provided means for providing the broadcast signals to a television receiver. Preferably the broadcast signals are combined with both of the satellite signals. In this case, a double-pole, double-throw switch can be used to couple the broadcast signals to the television receiver and for selectively connecting the satellite signals to the satellite receiver. Alternately, a diplexer can be used to separate the broadcast television signals.

In accordance with another aspect of the invention, a signal up-converter is provided for converting the second satellite signal to a second frequency band, higher than its original frequency band.

The first and second satellite signals are thereafter combined to provide a combined satellite signal to a single transmission line distribution system.

Preferably, broadcast signals from a broadcast receiving antenna system are also combined with the combined satellite signals.

Methods for distributing signals are also provided.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENTS

Figure 2:
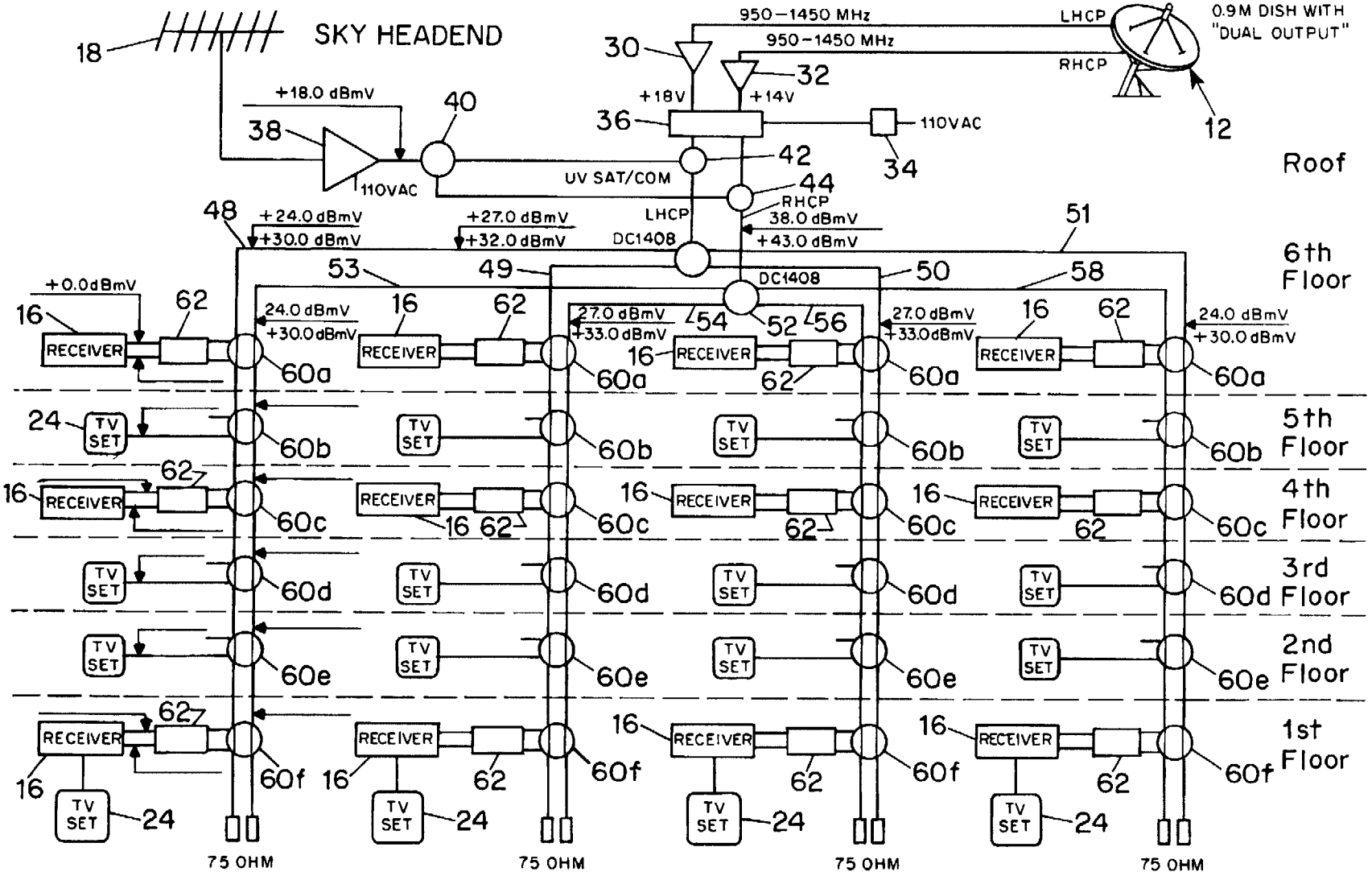
FIG. 2 is a block diagram showing a satellite television signal distribution system for a multiple dwelling unit according to the present invention.

FIG. 2 illustrates an embodiment of the present invention for loop thru distributing broadcast and satellite television signals to multiple users in an apartment building. In the embodiment illustrated in FIG. 2, the building has 6 floors with 4 apartments on each floor.

Those skilled in the art will recognize that this example is exemplary only and that the principles of the invention can be adapted to dwellings having greater or fewer apartments, and can be applied to communities having dwelling units in separate, attached or unattached units, such as condominiums.

The system of FIG. 2 is configured to provide the residents with options as to whether or not they desire to subscribe to a satellite-based, direct broadcast television system, and also provides a master television antenna system available to all residents, similar to currently used master antenna systems. This provides the ability to rebuild an existing master antenna television system by replacing old directional couplers with new ones and using existing cables and conduits.

As illustrated in FIG. 2, selected subscriber apartments are equipped with satellite receivers 16 while others are equipped with standard television sets 24 only. The system includes a signal acquisition arrangement, which is preferably located on the building roof adjacent the satellite antenna 12 and broadcast receiving antenna 18. It is also possible to locate some of the acquisition equipment in other portions of the building to accommodate existing cable systems. The signal acquisition equipment includes a parabolic satellite antenna with dual feed, dual polarity low noise block-converter feed 12 having outputs for left and right hand circular polarization, which are provided to separate amplifiers 30 and 32. The low noise block-converter feed and amplifiers are powered by a power supply 34 and power inserter 36 which may be arranged remote from the amplifiers 30, 32, which are preferably at or close to antenna 12.

Signals received on broadcast antenna 18 are provided to an amplifier 38 and thereafter to power divider 40. These broadcast signals are thereafter combined with the amplified satellite signals corresponding to left and right hand polarization in combiners 42 and 44 respectively. In a typical arrangement the satellite signals are in a frequency band of 950 to 1450 MHz, while broadcast signals from antenna 18 are within the frequency range 50 to 860 MHz. Accordingly, combiners 42, 44, which may be diplexers, can provide an output having an overall frequency band of 50 to 1450 MHz and containing both broadcast and satellite signals.

The output of combiner 42 is provided to splitter 46 and thereafter to transmission lines 48, 49, 50 and 51 which are serially routed through each of the apartments in the building. Likewise, the output of combiner 44 is provided to splitter 52 and routed to all apartments over transmission lines 53, 54, 56 and 58.

Figure 4:
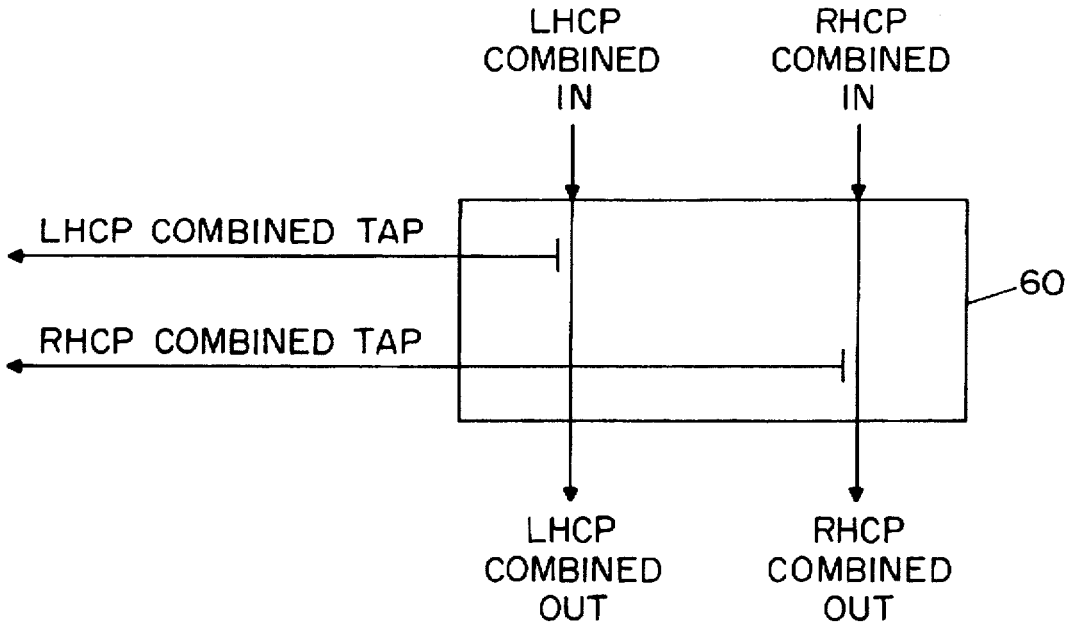
FIG. 4 is a block diagram showing a dual directional coupler for the system of FIG. 2.

Each apartment is provided with a dual output coupler 60, which has a coupling value dependent on its position within the distribution system. Coupler 60 is shown in FIG. 4.

Accordingly, dual couplers 60*a* provide output coupling of −25 db, couplers 60*b* provide −20 db, couplers 60*c* provide −16 db, couplers 60*d* provide −12 db, couplers 60*e* provide −12 db and couplers 60*f* provide −10 db.

The variation in coupling values of dual couplers 60 provides a relatively constant signal level for the output broadcast and satellite signals at each apartment, as indicated by the typical signal levels indicated in FIG. 2.

Signal levels required on the customer satellite device input should be not less than 0 dbm for the satellite signal and 6 dbm for the OFF-AIR signal.

Dual couplers 60 consist of conventional high frequency directional coupler devices with the selected values of coupled signal level. Essentially, each of the two directional couplers incorporated into device 60, provides a coupled signal from one of the transmission lines to an output terminal.

The equipment at each user installation depends on the service requested by that individual user. Accordingly, a user who merely desires to receive broadcast television signals may connect his television receiver 24 to either of the outputs of dual coupler 60, since both outputs include a signal corresponding to the broadcast signals received by antenna 18. No further equipment or signal processing is needed.

Figure 1:
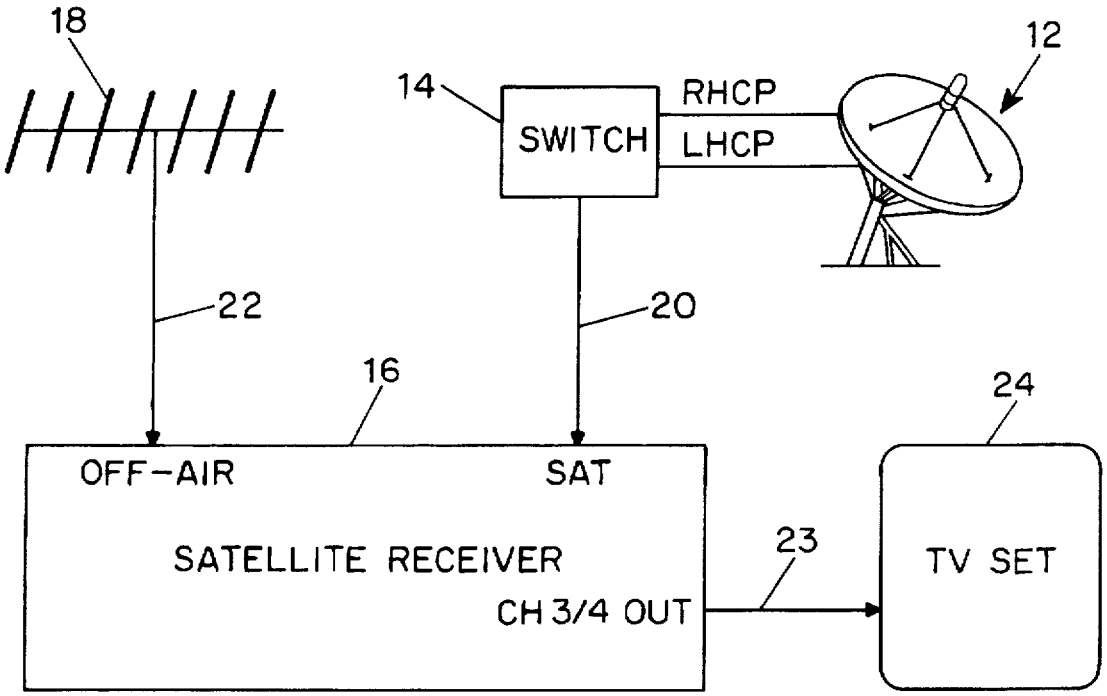
FIG. 1 (PRIOR ART)
FIG. 1 is a block diagram showing a direct satellite television receiving arrangement according to the prior art.
Figure 5:
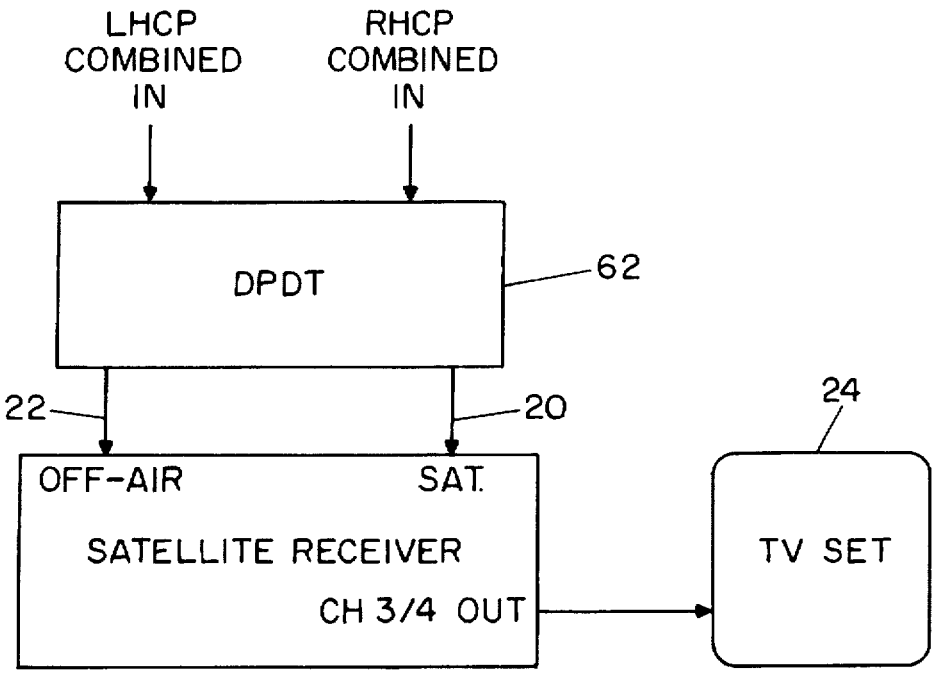
FIG. 5 is a block diagram showing a user location configuration for the system of FIG. 2.

In the event a user desires to subscribe to direct satellite television services, that user needs to be provided with additional equipment as shown in FIG. 5. In connection with the FIG. 5 arrangement the additional equipment consists of a double-pole, double- throw switch 62, having inputs connected to the cables carrying the combined left-hand and right-hand satellite signals and the broadcast signal. In this user installation the satellite receiver 16 and television set 24 are identical to those used in the prior art single-family home installation depicted in FIG. 1. The double-pole, double-throw switch 62 has inputs connected to the outputs of dual coupler 60 corresponding to the combined satellite and broadcast antenna signals, and has outputs connected to the off-air and satellite inputs of receiver 16.

When receiver 16 is tuned to receive a satellite channel, the switch signal on cable 20 controls switch 62 thus directing an appropriate combined signal to the satellite terminal of receiver 16.

When receiver 16 is tuned to receive off-air broadcast television signals, the position of switch 62 is unimportant, since either position of switch 62 provides the off-air signal on cable 22.

Figure 6:
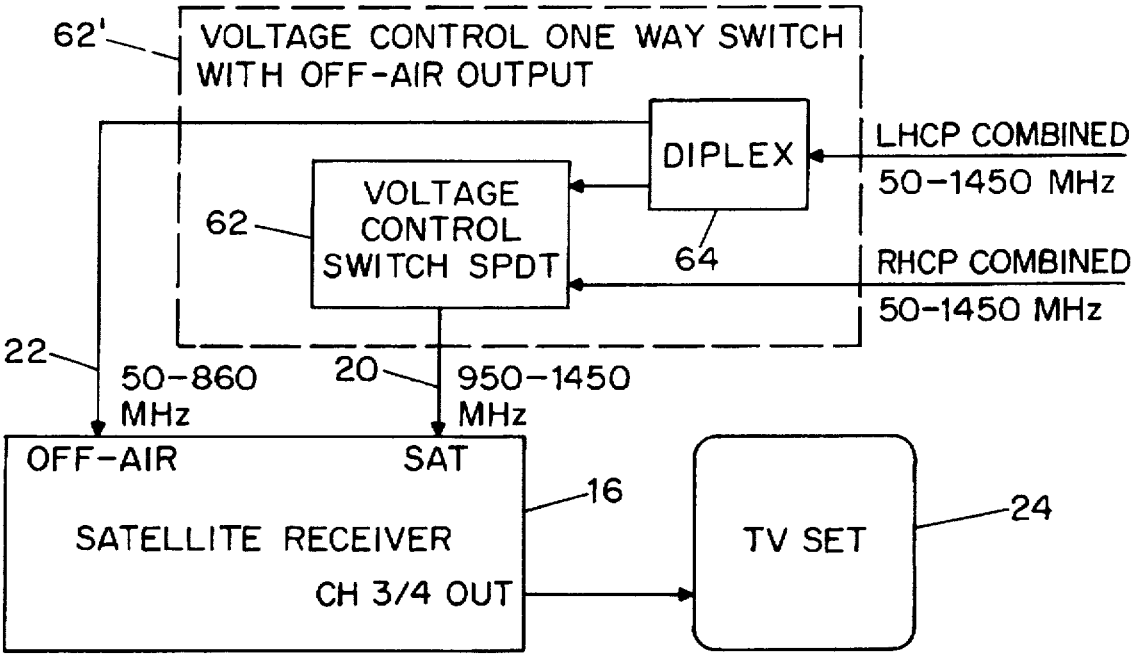
FIG. 6 is a block diagram showing an alternate user location configuration for the system of FIG. 2.

Another arrangement shown in FIG. 6 uses a combined diplexer/switch 62' instead of double-pole, double-throw switch 62. Diplexer 64 continuously provides the off-air signal on cable 22 and single-pole, single-throw switch 65 selects the satellite signal. Using the arrangement of FIG. 6, it is unnecessary to provide the off-air signal on both distribution cables, it being only necessary to provide the off-air broadcast signal combined with one polarization, such as the LHCP signal provided to diplexer 64, as shown in FIG. 6. This arrangement, however, makes the configuration sensitive to installation errors in connecting cables to coupler 60.

Figure 3:
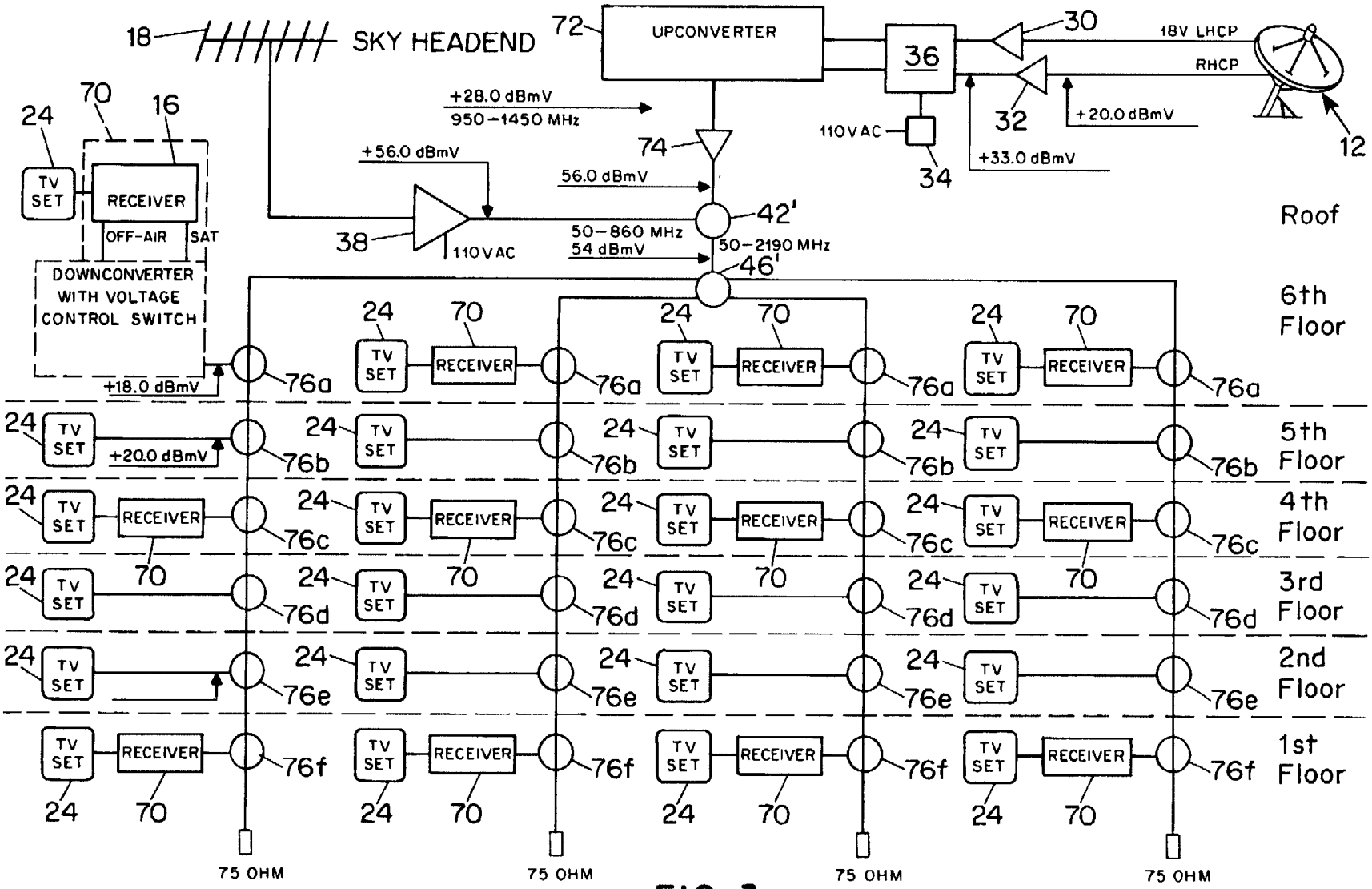
FIG. 3 is a block diagram showing an alternate satellite television signal distribution system in accordance with the present invention.

FIG. 3 is a block diagram illustrating an alternate embodiment for the distribution system of the present invention wherein only a single transmission line distribution system is required.

The FIG. 3 embodiment has a disadvantage, in that it is necessary to provide modifications to the satellite receiver of the standard type in order to implement the single cable distribution system, as will be explained.

In the system of FIG. 3, right and left-hand polarization signals are provided by antenna 12 to corresponding amplifiers 30 and 32 as in the FIG. 2 embodiment. The signal corresponding to right-hand polarization, which has an initial frequency band of 950 to 1450 MHz is provided to up converter and combiner 72 wherein the frequency band is converted to the frequency band of 1690 to 2190 MHz and thereafter combined with the signal corresponding to left-hand polarization. Preferably combining is done in a diplexer, which provides an output combined satellite signal having a frequency band of 950 to 2190 Mhz. Broadcast signals received on antenna 18 and amplified by amplifier 38 are combined with the output of head-end amplifier 74 in combiner 42' whose output includes signals in the range of 50 to 860 MHz corresponding to broadcast television signals, signals in the range of 950 to 1450 mHz, corresponding to left-hand circular polarization signals, and signals in the range of 1690 to 2190 MHz corresponding to the frequency up-converted right-hand polarization satellite signals.

All of these combined signals are provided to splitter 46' for distribution to the user locations utilizing a single cable distribution network. At each user location there is provided a suitable coupler 76 for providing output signals to a satellite receiver or television set, according to the requirements of the individual user. Where a user desires to only receive broadcast transmissions, the signal from couplers 76 may be directly provided to a television set 24.

Figure 7:
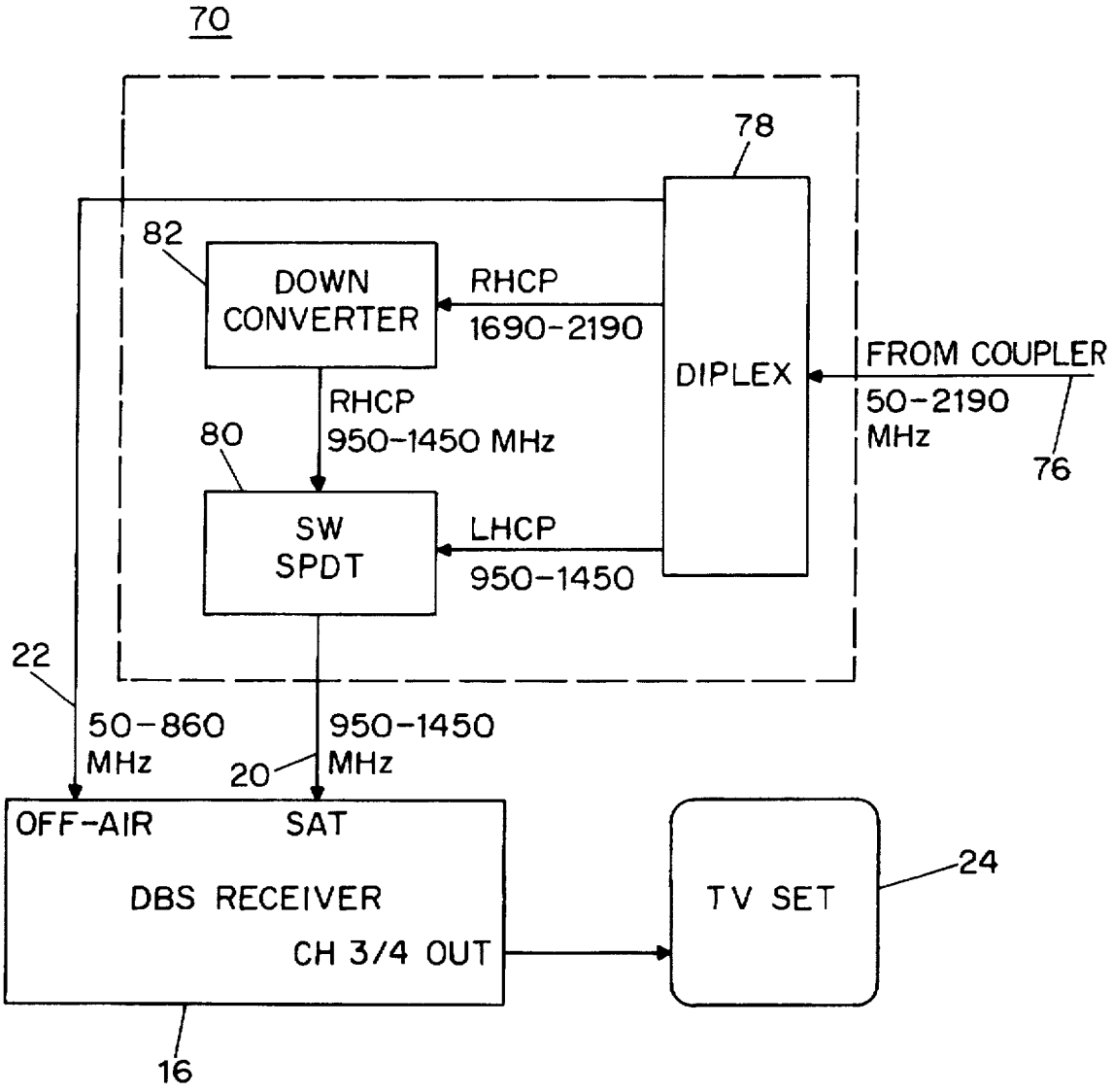
FIG. 7 is a block diagram showing a user location configuration for the distribution system of FIG. 3.

The television set responds only to the signals in the frequency range 50 to 860 mHz and provides normal television operation.

Where the user desires to receive direct satellite television signals, as well as broadcast signals, the signal from coupler 76 is provided to specially adapted satellite receiver 70 as shown in FIG. 7. Receiver 70 incorporates a standard satellite receiver 16, diplexer 78 switch 80 and a down converter 82.

Switch 80 is operated similar to switch 62 of FIG. 4 to select between satellite signals corresponding to left and right hand circular polarization. If, for example, signals corresponding to left hand circularly polarized transmissions contain the desired channel, switch 80 is configured to connect the signal from coupler 76 through diplexer 78 to the input of satellite receiver 16.

On the other hand, if the up-converted satellite signals corresponding to right-hand circular polarization are to be received, switch 80 is operated by a control signal on line 20 to connect the signal from coupler 76 through diplexer 78 to down converter 82 and thereafter to the input terminal of satellite receiver 16.

Alternately a specially designed receiver which equipped with a RF tuner operating directly with the input frequencies of 950–2190 MHz may be provided.

While there have been described what are believed to the preferred embodiments of the present invention, those skilled in the art will recognize that other and further modifications thereof may be made without departing from the true spirit of the invention, and it is intended to claim all such changes and modifications as fall with the scope of the invention.

I claim:

1. A system for distributing broadcast and satellite television signals to multiple users, comprising a satellite antenna system for receiving satellite signals having first and second polarizations and for providing corresponding first and second satellite signals on respective first and second transmission lines; a broadcast signal antenna system for receiving broadcast signals and for combining said broadcast signals with said satellite signals on at least one of said transmission lines; a dual transmission line distribution system for providing said satellite and broadcast signals to a plurality of user locations; means at said user locations for providing said broadcast signals to a user's television receiver; and a switch at selected user locations for selectively connecting said first or second satellite signals to a satellite signal receiver.

2. A system as specified in claim 1 wherein said broadcast signal antenna system combines said broadcast signals with both of said first and second satellite signals.

3. A system as specified in claim 2 wherein a double-pole, double-throw switch is provided at said selected user locations, and wherein said double pole switch comprises said means for providing said broadcast signals to said television receiver and said switch for connecting said first or second satellite signals to a satellite receiver.

4. A system as specified in claim 1 wherein said means for providing said broadcast signals to a television receiver comprises a diplexer.

5. A system for distributing broadcast and satellite television signals to multiple users, comprising: a satellite antenna system for receiving satellite signals having first and second polarizations and a first frequency band, and for providing corresponding first and second satellite signals on respective first and second transmission lines; a signal up-converter for converting said second satellite signal to a second frequency, band higher than said first frequency band; a diplexer for combining said first satellite signal having said first frequency band and said up- converted second satellite signal having said second frequency band to provide combined satellite signals; a broadcast signal antenna system for receiving broadcast signals and for combining said broadcast signals and said combined satellite signals; a transmission line distribution system for providing said combined satellite and broadcast signals to a plurality of user locations; means at said user location for providing said broadcast signals to a user's television receiver; and a satellite signal receiver at selected user locations for receiving said combined satellite signal.

6. A system as specified in claim 5 wherein said means for providing said broadcast signals to a television receiver comprises a diplexer.

7. A system for distributing satellite television signals to multiple users, comprising: a satellite antenna system for receiving satellite signals having first and second polarizations and a first frequency band, and for providing corresponding first and second satellite signals on respective first and second transmission lines; a signal up-converter for converting said second satellite signal to a second frequency band higher than said first frequency band; a diplexer for combining said first satellite signal having said first frequency band and said up- converted second satellite signal having said second frequency band to provide combined satellite signals; a transmission line distribution system for providing said combined satellite signals to a plurality of user locations; and a satellite signal receiver at selected user locations for receiving said combined satellite signal.

8. A method for distributing satellite television signals to multiple users from a common satellite antenna system having first and second output ports corresponding to left and right hand polarized satellite signals consisting of converting signals from one of said output ports to a selected frequency band, higher than the frequency band of signals from the other of said output ports, combining said converted signals with the signals from said other output port, and distributing said combined signals to user locations.

* * * * *